United States Patent [19]

Dozier

[11] Patent Number: 4,555,114

[45] Date of Patent: Nov. 26, 1985

[54] TABLE GAME PUCK

[76] Inventor: William Dozier, Rte. 1, Siloam Springs, Ark. 72761

[21] Appl. No.: 547,013

[22] Filed: Oct. 31, 1983

[51] Int. Cl.[4] ..... A63B 71/00

[52] U.S. Cl. ..... 273/128 R; 273/126 R; 273/424

[58] Field of Search ..... 273/126 R, 126 A, 128 R, 273/288, 424, 425, DIG. 8, 428; D21/51; D32/40; 15/244 B, 244 C

[56] References Cited

U.S. PATENT DOCUMENTS

| | | | |
|---|---|---|---|
| 692,010 | 1/1902 | Gottschalk | 15/244 C |
| 1,564,443 | 12/1925 | Rabold | D21/51 |
| 3,099,450 | 7/1963 | Randall | 273/423 |
| 3,801,675 | 4/1974 | Russell | 604/369 |
| 4,000,028 | 12/1976 | Hoey et al. | 604/369 |
| 4,153,253 | 5/1979 | White | 273/128 R |
| 4,196,540 | 4/1980 | Hambree | 273/424 |

FOREIGN PATENT DOCUMENTS

| | | | |
|---|---|---|---|
| 297437 | 6/1929 | United Kingdom | 15/244 C |

*Primary Examiner*—Richard C. Pinkham
*Assistant Examiner*—T. Brown
*Attorney, Agent, or Firm*—Robert R. Keegan

[57] ABSTRACT

There is disclosed a puck for use in a parlor game played on a table top or the like in which the principal object is to flip the puck with a finger and lag it to overhang the opposite edge of the table; the puck comprises a body of foam material with vertical sides with a low density of approximately three pounds per cubic foot and in the shape of an acute triangle having sides somewhat more than two inches; corners of said triangle are rounded to a radius of about one-quarter inch; the puck is about one-half inch thick and has a bottom surface layer of non-woven nylon fabric with a coefficient of sliding friction on clean, dry glass of approximately 0.8. The top of the foam body has adhered thereto a triangular piece of plastic sheet material on which advertising or other indicia may be printed.

14 Claims, 3 Drawing Figures

TABLE GAME PUCK

The present invention relates to a slideable token for use in a parlor game played on a table top; for want of a better word the slideable token will be referred to as a puck, although it has very few characteristics in common with a hockey puck. The puck in its preferred embodiment is formed of plastic foam material about one-half inch thick and is in the shape of an acute triangle. It preferably has certain characteristics which are advantageous in playing a particular table game and also characteristics which prevent accidental injury through misuse and which minimize noise in playing the game.

While the puck is not limited to use in one particular game, the game for which it is particularly suited will be briefly described to aid in understanding the desirability of the characteristics of the puck according to the invention. It is a game for two people seated across from one another at a table which may be from two feet to four feet wide. The primary object is to flip the puck with the forefinger to cause it to slide across the table just to the edge of the opposite side. A "score" is made if part of the puck is off the table. Penalities are assessed for repeatedly overshooting the edge of the table and additional scores may be made by flipping the puck from an on-edge position through the upheld fingers of the opposing player in simulation of a football field goal or extra point conversion. The game has a scoring formula which simulates football.

The rules of the game are, of course, not a part of the present invention, but they help point out the usefulness of the specific characteristics of the puck according to the invention. The game itself is basically old having typically been played with a hard triangular token or puck folded from one or more sheets of paper. The game puck according to the present invention offers important advantages over the traditional paper token including those mentioned above and others referred to in the following description.

It is an object of the present invention to provide a parlor game puck in the form of a flat bottomed triangular token of resilient foam material which holds its shape, but at the same time has no sharp corners or edges which could produce injury even if the puck is projected at high velocity.

It is another object of the present invention to provide such a puck of sufficiently low density that it will not be injurious and will not constitute a hazardous or damage-causing projectile.

It is still another object of the present invention to provide a game puck of resilient material and low density having a bottom surface with a moderately high coefficient of sliding friction whereby the puck may be lagged on a flat smooth surface with accuracy and consistency.

It is a further object of the present invention to provide such a puck with a flat side to stand on edge and be flipped in a manner to leave the table surface.

Other objects and advantages of the present invention will be apparent from consideration of the following description in conjunction with the appended drawings in which.

Figure 1:
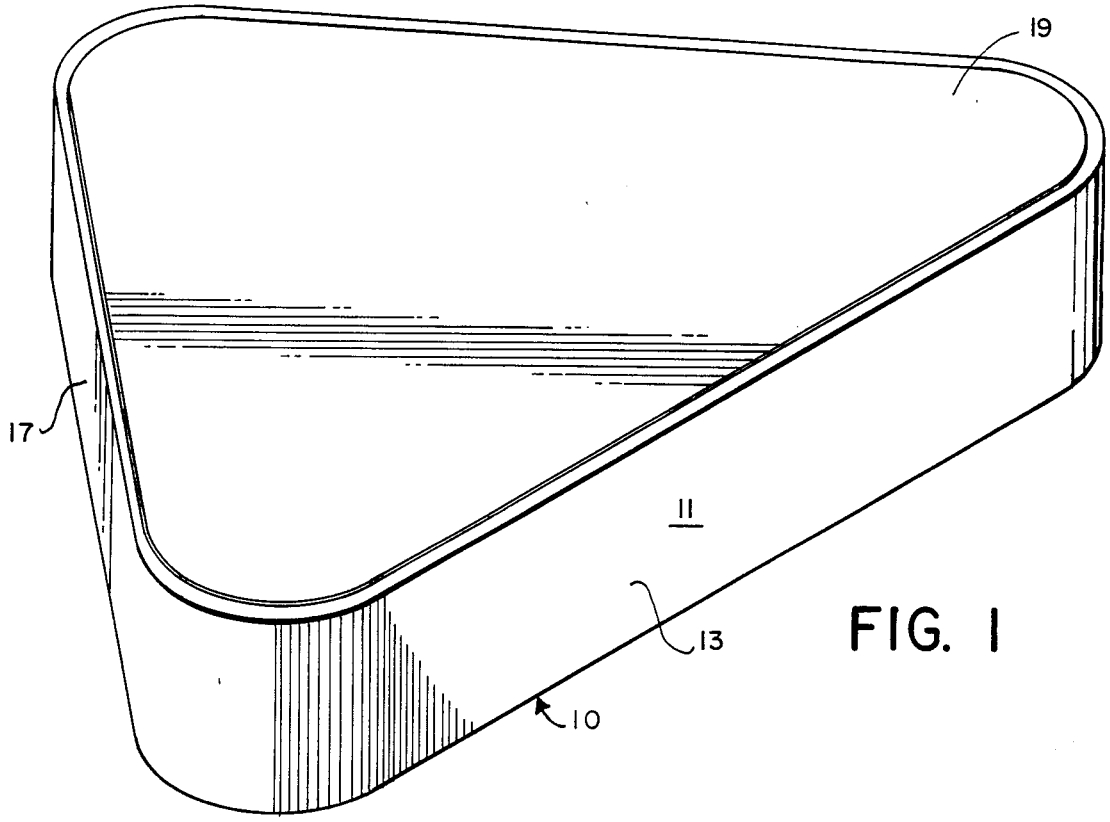
FIG. 1 is an isometric view of a game puck according to the invention.

Referring to the drawings, the game puck 10 according to the invention comprises a body 11 of foam plastic material. The density is less than ten pounds per cubic foot and, more particularly, less than five pounds per cubic foot. The foam has a firmness of greater than 50 pounds for an Indentation-Load-Deflection (ILD) of 25% and, more specifically, a firmness of from 60 pounds to 120 pounds for an ILD of 25%. In a preferred embodiment the body 11 is a polyether urethane polymer foam material having a density of about three pounds per cubic foot and a 25% ILD of 100 pounds. (Note: ILD is a term used for furniture upholstery cushions and carpet pads standing for Indentation-Load-Deflection and corresponds to force on a 50 square inch circular disk to cause the noted percentage of deflection in compression.)

Figure 3:
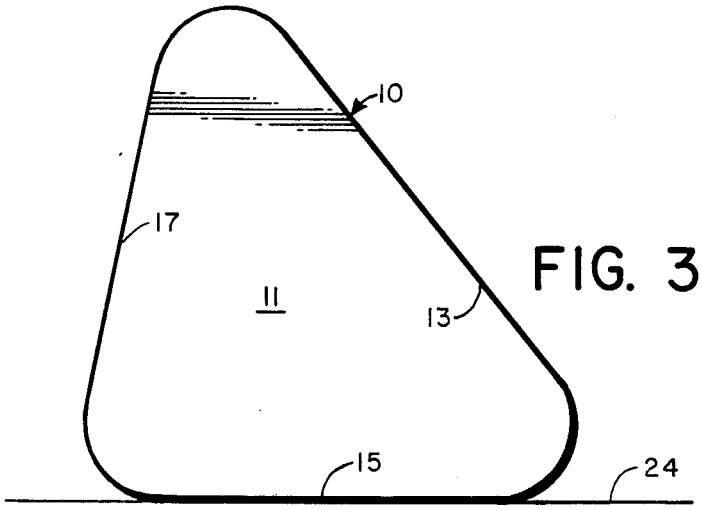
FIG. 3 is an elevational view of the game puck of FIG. 1 standing on edge, showing the bottom surface thereof.

The outline of the game puck as shown in FIG. 3 is generally triangular with sides 13, 15, and 17; in the preferred embodiment the corners of the triangle are blunted or rounded rather than being sharp. The triangle should have one angle of between 75° and 105°. The particular outline as shown in the drawings and particularly FIG. 3 is an isoscles triangle. The equal angles are acute and the third angle is slightly less than 90°. Although this is the preferred shape of the puck 10 it may take the form of an equilateral triangle, an obtuse triangle, or some other form of polygon. The shape of the puck is not limited to a polygonal shape and other shapes could be utilized with a circular shape being the least preferred. It is preferred that any corners be rounded, however.

The dimensions of the game puck are also subject to variation, but the preferred embodiment has an inscribed circle of one and one-half inches diameter and a circumscribed circle (for the complete triangle without corner rounding) of about three and one-half inches diameter. Put in another way, the complete triangle has two sides of about two and three-quarters inches and one side of about three and five-eights inches; the corners of the puck are rounded to a radius of about one-quarter inch.

Figure 2:
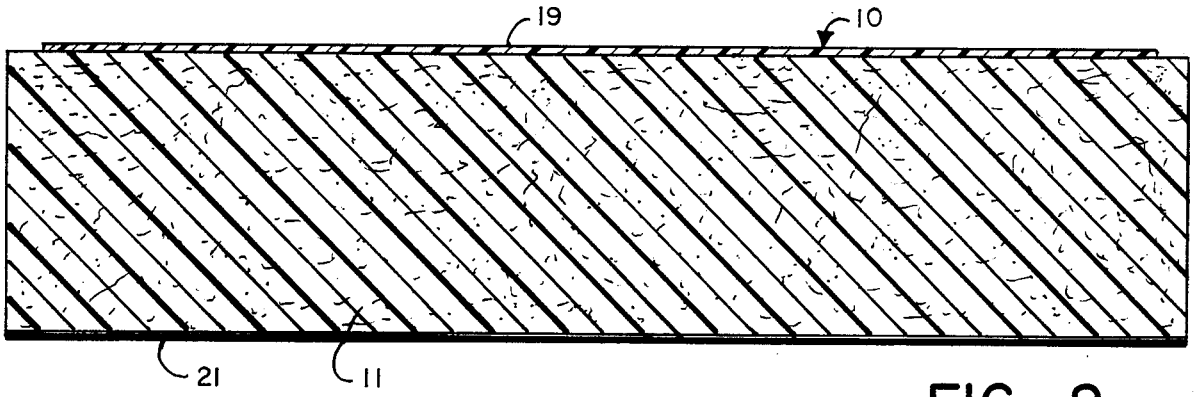
FIG. 2 is a vertical sectional view of the game puck of FIG. 1.

As shown in FIG. 2 the top of the puck 10 has adhered thereto a thin sheet of plastic material 19 which is of a shape similar to the puck but with dimensions of one-eighth inch to one-quarter inch less than the puck. In the illustrated embodiment sheet material 19 does not enter into the performance of the puck and is primarily to provide a surface for printing identifying material, decorative designs, advertising, or the like in a visible position on the puck. Sheet material 19 could be used as the bottom sliding surface for puck 10, however.

The bottom of the puck 10 has a thin sheet material 21 heat-sealed or otherwise adhered thereto which is preferably a non-woven fibrous plastic material such as non-woven Nylon 6—6 sheet of 3 oz. per sq. ft. weight made and sold under the name Cerex. Sheet material 21 serves to give the puck a predetermined controllable coefficient of friction and thus provide uniform action in play of the game. The preferred coefficient of friction for the puck on clean, dry window glass is 0.8. The sheet material 21 provides a fibrous surface on the bottom of the puck with an effect analogous to the surface provided by the felt on a billiard table interacting with a smooth billiard ball. The sides 13, 15, and 17 of puck body 11 are flat and at right angles to bottom 21. Puck body 11 will thus stand on edge. This facilitates the "field goal" aspect of the parlor game, particularly if the puck is in the position shown in FIG. 3 and flipped from the left to right direction.

Plastic foam material having a fibrous sheet material adhered thereto meeting the above specifications is available. Such material is made by E. R. Carpenter Co., Dallas, Tex., and marketed under the designation Rich Step #1.

Plastic foam or plastic foam material for the purpose of this description and the claims will be defined to include cellular plastics, polyurethane resins, porous plastics, foam rubber, sponges, and expanded plastics.

The sheet plastic material 19 is optional and may be omitted. It may be formed of polymeric sheet, of film, of paper, either plastic-coated or uncoated, or woven or non-woven textile fabric, or of any other suitable sheet material. It will normally be printed before being applied to the puck body 11 by adhesive, by heat-sealing, or by other procedures. Such material may also be used as the bottom sliding surface of the puck.

In theory the plastic foam body 11 itself could have a bottom surface with a coefficient of friction and other characteristics which would avoid the necessity for sheet material adhered to the bottom of puck body 11, but suitable foams tend to have very high coefficients of friction. In practice it has been found preferable to have a layer of sheet material 21 adhered to the bottom of body 11 to provide optimum sliding characteristics and also close the pores of the foam to avoid collection of dirt and other particles on the bottom of the puck. This material may take different forms including woven or unwoven fabric or paper-like material, or it may be created by heat-treatment of the foam body 11 or by spraying or otherwise coating the foam body surface. It is desired that the sliding friction coefficient of the bottom surface of the puck formed by sheet material 21 in the preferred embodiment be between about 0.3 and 0.9. The starting friction coefficient is preferably not substantially greater than the sliding friction coefficient value. It should be appreciated that friction coefficients often are not subject to very accurate determination, particularly in the case of foams and fibrous materials.

Numerous variations or modifications to the invention have been described or suggested, but it will be apparent to those skilled in the art that other variations and modifications may be made within the scope of the invention and accordingly the scope of the invention is not to be construed to be limited to the particular embodiments described or suggested but is rather to be determined by reference to the appended claims.

What is claimed is:

1. A parlor game puck comprising a body of plastic foam material having a density of less than ten pounds per cubic foot, a height of from one-quarter inch to one inch, a horizontal surface outline for which an inscribed circle is less than two inches diameter and a circumscribed circle is greater than two inches diameter, a flat bottom, at least one side with a flat surface at a right angle to said flat bottom, and a surface on the bottom of said body having a sliding friction coefficient on clean, dry window glass between 0.3 and 0.9.

2. Apparatus as recited in claim 1 wherein said surface on the bottom of said body is formed by a layer of non-woven fibrous material.

3. Apparatus as recited in claim 2 wherein said material is heat-sealed to said body.

4. Apparatus as recited in claim 1 wherein said density is less than five pounds per cubic foot.

5. Apparatus as recited in claim 1 wherein said outline is in the form of a triangle having one angle between 75° and 105° and having rounded corners.

6. Apparatus as recited in claim 1 wherein said plastic foam material is resilient and has an ILD for 25 percent deflection of greater than 50 pounds.

7. A parlor game puck comprising a flat bottomed body of resilient urethane plastic foam material having a density of less than ten pounds per cubic foot, a uniform height of from one-quarter inch to one inch, and a horizontal surface outline of generally triangular shape with rounded corners, an inscribed circle for said triangle being less than two inches diameter and a circumscribed circle being greater than two inches diameter, said foam having a firmness of from 60 pounds to 120 pounds for 25% Indentation-Load-Deflection, and a surface layer on the bottom of said body having a sliding friction coefficient on clean, dry glass between 0.7 and 0.85.

8. Apparatus as recited in claim 7 wherein said body has at least one side including a flat surface at a right angle to the bottom of said body whereby said body may be placed in a stable position with said one side in contact with the flat horizontal surface of a table top or the like.

9. Apparatus as recited in claim 7 wherein said surface on the bottom of said body is formed by a layer of non-woven fibrous material.

10. Apparatus as recited in claim 7 wherein said triangular shape has one angle between 75° and 105°.

11. A parlor game puck comprising a body of plastic foam material having a density of less than ten pounds per cubic foot, a height of from one-quarter inch to one inch, and a horizontal surface outline for which an inscribed circle is less than two inches diameter and a circumscribed circle is greater than two inches diameter and a sheet of non-woven material adhered to the bottom of said body having a sliding friction coefficient on clean, dry glass between 0.3 and 0.9.

12. Apparatus as recited in claim 11 wherein said material is heat-sealed to said body.

13. Apparatus as recited in claim 11 wherein said density is less than five pounds per cubic foot.

14. Apparatus as recited in claim 11 wherein said outline is in the form of a triangle having one angle between 75° and 105° and having rounded corners.

* * * * *